United States Patent [19]

Dolev

[11] Patent Number: 4,935,024

[45] Date of Patent: Jun. 19, 1990

[54] HAIR REMOVAL DEVICE

[76] Inventor: Moshe Dolev, 4 Hamitnachalim St., Ramat Hasharon, Israel

[21] Appl. No.: 340,529

[22] Filed: Apr. 19, 1989

[30] Foreign Application Priority Data

Feb. 14, 1989 [IL] Israel ..... 89290

[51] Int. Cl.[5] ..... A61B 17/50

[52] U.S. Cl. ..... 606/133

[58] Field of Search ..... 128/355; 17/11.1 R, 17/47; 132/73, 73.6; 606/131, 133

[56] References Cited

U.S. PATENT DOCUMENTS

| | | | |
|---|---|---|---|
| 1,232,617 | 7/1917 | Shipp . | |
| 1,743,590 | 1/1930 | Binz . | |
| 2,112,230 | 3/1938 | Fisher | 17/11.1 |
| 2,423,245 | 7/1947 | Magnus et al. | 128/355 |
| 2,458,911 | 1/1949 | Kerr | 128/354 |
| 2,486,616 | 11/1949 | Schubiger | 128/354 |
| 2,496,223 | 1/1950 | Lanzisera | 17/11.1 |
| 2,592,484 | 4/1952 | Smith | 128/354 |
| 2,900,661 | 8/1959 | Schnell | 17/11.1 |
| 4,079,741 | 3/1978 | Daar et al. | 128/355 |
| 4,279,253 | 7/1981 | Haes et al. | 128/355 |
| 4,524,772 | 6/1985 | Daar et al. | 128/355 |
| 4,575,902 | 3/1986 | Alazet | 19/2 |
| 4,726,375 | 2/1988 | Gross et al. | 128/355 |
| 4,807,624 | 2/1989 | Gross et al. | 128/355 |

FOREIGN PATENT DOCUMENTS

| | | |
|---|---|---|
| 2245314 | 4/1975 | France . |
| 2307491 | 11/1976 | France . |
| 81780 | 9/1988 | Israel . |
| 179261 | 12/1935 | Switzerland . |
| 268696 | 9/1950 | Switzerland . |
| 203970 | 9/1923 | United Kingdom . |

*Primary Examiner*—Michael H. Thaler
*Assistant Examiner*—William Lewis
*Attorney, Agent, or Firm*—Edward Langer

[57] ABSTRACT

A motor-powered depilatory device for removing skin hair which is provided in a compact, efficient, hand-held unit, based on the operation of an axially rotatable hair-plucking element provided as a plurality of discs adjacently coupled in column form. By provision of a central spine comprising a pre-tensioned spring, the discs are maintained adjacent one another under tension, while the column is bendable. When rotated axially at one end, the hair-plucking element transfers the rotation via rotational coupling of the adjacent discs in the column. Thus, even if the column is bent in an arched configuration, the rotational motion is transferred across its entire length. Preferably, the rotationally-coupled discs are made of relatively rigid plastic material, and are mechanically coupled by a set of tab-like projections on each disc surface, which engage matching recesses in adjacent discs. Alternatively, adjacent discs are made of a soft material with a high friction coefficient and are rotationally coupled by friction between them. The arched configuration of the hair-plucking element provides spaces between adjacent discs on a convex side, and hair trapped in these spaces is plucked when they close upon rotation of the hair-plucking element toward its concave side.

8 Claims, 2 Drawing Sheets

HAIR REMOVAL DEVICE

FIELD OF THE INVENTION

The present invention relates to motorized depilatory devices for removing unwanted skin hair, and more particularly, to a new and useful hair removal device which plucks out skin hair based on the operation of a novel coupled-disc element.

BACKGROUND OF THE INVENTION

The prior are of motor-powered depilatory devices for removing skin hair is based on a well-known concept disclosed in a patent covering an earlier mechanical device, namely Swiss Pat. No. 268,696 to Fischer. There, a helical spring is arched to provide spaces between loops of its convex side, and the spring is placed on the skin under slight pressure and rolled in the direction of hair growth. The rolling motion of the helical spring causes hairs which become trapped in the spaces between the coil loops on the convex side to be plucked when these spaces close on the coil spring concave side.

U.S. Pat. No. 4,524,772 to Daar, et. al., discloses an arched helical spring which is provided with high speed rotational motion via motor-driven couplings connected at its ends. As with the helical spring in the mechanical design of Fischer, the power-driven helical spring grabs individual hairs when the spaces between its loops close. Upon detailed inspection it is seen that the contact between the helical spring wire and individual hairs is essentially point-like. In some cases, rather than being plucked and removed, the hair is instead torn or cut at a weak point thereon, leaving hair "stubble" on the skin.

Once a hair becomes trapped between closed helical spring loops, continued application of rotational force causes the spring to "wind up" since it is composed of flexible wire material, yet the hair is still in place. As the spring continues to "wind", the pulling tension applied to the hair increases until the necessary force is developed for plucking. Because a finite interval s required for this force to be developed, the user is subjected to an increased pain level. This problem has been identified in connection with the commercial model of the device sold under this patent.

As with other metal objects continually subjected to bending stresses, or due to manufacturing defects, the helical spring may break during use, creating a hazard of puncturing and penetrating the skin over which it passes. Another disadvantage to this design is the transverse deflection of hair due to lateral movement of the spaces between the helical spring loops which rotate in spiral fashion. This tends to limit the degree of certainty that hairs will be plucked, as shorter hairs will not remain within a given loop as it moves laterally.

In U.S. Pat. No. 4,726,375 to Gross, et. al., a motor-powered depilatory device is disclosed which employs a hair-plucker body comprising a plastic or rubber cylindrical member having a smooth outer surface formed with a plurality of partially circumferential slits. The cylindrical member is rotatable about its longitudinal axis and is supported in an arcuate position such that the slits open and close during rotation, trapping and plucking hairs therein. Because they are only partially circumferential, the slits are effective only during a portion of the rotation, reducing overall efficiency.

By use of the soft plastic or rubber material, a greater contact area is afforded the individual hairs which are trapped within the slits of the cylindrical element. While this represents an important departure from the helical spring plucking operation, the soft plastic or rubber material also exhibits the "winding" phenomenon because of its flexibility. Thus, this design is also subject to increasing the pain associated with plucking of individual hairs.

In addition, since the material is soft and has a high friction coefficient, friction with the skin is increased, requiring an increased motor rating for maintaining a given rotational speed. Also, the partially circumferential slits in the plucker body constitute weak points, causing it to "tear" apart and limiting its durability.

In U.S. Pat. No. 4,575,902 to Alazet, there is disclosed a depilatory device comprising a series of adjacent, closely-spaced hair-plucking discs driven by an electric motor housed within a casing. The discs are periodically deformed during their rotation, such that adjacent ones thereof are pressed together to pluck hairs which may have become trapped between them when the unit is passed over the skin. Besides its mechanical complexity, a drawback to this design is associated with the fact that the discs close only periodically, making the plucking action inefficient by limiting it to a short time interval.

U.S. Pat. No. 2,900,661 to Schnell discloses a plucking device for feathers, hairs or the like in which at least one pair of discs rotate at an angle to each other and converge at one contact point whereat hairs are plucked. The disadvantage associated with this design stems from the large spacing between disc pairs, which reduces efficiency, in addition to being expensive and complicated.

Therefore, it would be desirable to provide a power-driven depilatory device which provides efficient hair removal and reduces hair stubble, while minimizing pain associated with the interval between grasping and plucking of individual skin hairs.

It would also be desirable to provide a depilatory device which is simple in construction for cost-effective production, while durable in use.

Additionally, it would be desirable to provide a depilatory device which minimizes heat and friction when in contact with skin, while also eliminating helical spring breakage hazards near the skin.

SUMMARY OF THE INVENTION

Accordingly, it is a principal object of the present invention to overcome the above-mentioned disadvantages and provide a motor-powered depilatory device for removing skin hair which is provided in a compact, efficient, hand-held unit.

It is another object of the invention to provide a depilatory device based on the operation of an axially rotatable hair-plucking element which exhibits only a very limited amount of axial "twisting", thereby minimizing the plucking interval between grasping and pulling of individual hairs, and reducing the pain associated with the procedure.

In accordance with a preferred embodiment of the present invention, there is provided a motor-powered depilatory device comprising:

a manually-held housing;

motor means disposed in said housing; and a longitudinal hair-plucking element coupled at an end thereof to said motor means and being rotatably supported by said housing in arched configuration, said hair-plucking element comprising a plurality of adjacent, axially-aligned discs each having a hole formed centrally therein, the holes of said plurality of discs defining a cavity through which there extends a tensioning means for rotationally coupling said plurality of discs by flexibly retaining them adjacent one another under a predetermined tension, said arched configuration providing said hair-plucking element with spaces on a convex side thereof between adjacent ones of said plurality of rotationally-coupled discs, said spaces being closed on a concave side thereof.

rotational motion provided to said hair-plucking element while it is passed over the skin causing plucking of hair trapped within said spaces upon closure of same during rotation.

In the preferred embodiment, the hair-plucking element is provided as a plurality of discs adjacently coupled in column form. By provision of a central spine comprising a pre-tensioned spring, the discs are maintained adjacent one another under tension, while the column is bendable. When rotated axially at one end, the hair-plucking element transfers the rotation via rotational coupling of the adjacent discs in the column. Thus, even if the column is bent in an arched configuration, the rotational motion is transferred across its entire length.

Preferably, the rotationally-coupled discs are made of relatively rigid plastic material, and are mechanically coupled by a set of tab-like projections on each disc surface, which engage matching recesses in adjacent discs. Alternatively, adjacent discs are made of a soft material with a high friction coefficient and are rotationally coupled by friction between them.

The arched configuration of the hair-plucking element provides spaces between adjacent discs on a convex side, and hair trapped in these spaces is plucked when they close upon rotation of the hair-plucking element toward its concave side. In the preferred embodiment, manufacture of the mechanically-coupled plurality of discs from relatively rigid material eliminates the tendency for axial "twisting", thereby reducing the time interval between grasping and plucking of individual hairs to a minimum. Thus, hair removal is quick, smooth, efficient and substantially less painful than in prior art designs.

A feature of the inventive hair-plucking element design is the provision of tapered, outer converge and close on the adjacent discs. Then these discs converge and close on the concave side during rotation, individual hairs are trapped between facing sides of the discs which are parallel one another. This provides a greater surface area of contact with the hair, which results in a greater degree of certainty that individual hairs which become trapped will in fact be plucked from the skin. This is an important advantage over the helical spring construction discussed in the background, where essentially a single point of contact is made with an individual hair, increasing the likelihood of tearing rather than plucking it.

Another important advantage of the present invention vis-a-vis the prior art helical spring design is the fact that the contact point with any given hair between individual discs does not move laterally but remains in the same location. In contrast, rotation of the helical spring moves the contact points to the side, deflecting the hair. The result is that hairs of insufficient length do not remain in the spaces between loops long enough for them to close and pluck the hair.

By virtue of its construction from relatively rigid material when mechanically coupled, the hair-plucking element of the present invention provides a durable design capable of repeated usage. Because of its relative rigidity, contact between the coupled discs and individual hairs is made along a line corresponding to the hair's length, rather than at a singular point as occurs with the helical spring approach. The increased surface area over which individual hairs are grasped ensures a greater degree of certainty that plucking rather than tearing will occur.

Provision of the tensioning means within the cavity defined by the holes formed in the discs eliminates the breakage hazard presented in the prior art helical spring design. Thus, even if the tensioning means should break, since it is not proximate the skin, it cannot cause injury.

Because the inventive hair-plucking element is constructed of individual discs, transfer of rotational power when frictionally coupled does not subject it to the creation of weak points in the spaces between the coupled discs. This is an advantage over the design of the Gross patent, where the partially circumferential slits constitute weak points which tend to "tear" the soft rubber or plastic material, reducing its durability.

Despite the many advantages of the inventive hair-plucking element over the prior art, the hair removal device of the invention is simply constructed, allowing for cost-effective production.

Other features and advantages of the invention will become apparent from the drawings and the description contained hereinbelow.

BRIEF DESCRIPTION OF THE DRAWINGS

For a better understanding of the invention with regard to the embodiments thereof, reference is made to the accompanying drawings in which like numerals designate corresponding elements or sections throughout, and in which.

DETAILED DESCRIPTION OF A PREFERRED EMBODIMENT

Figure 1:
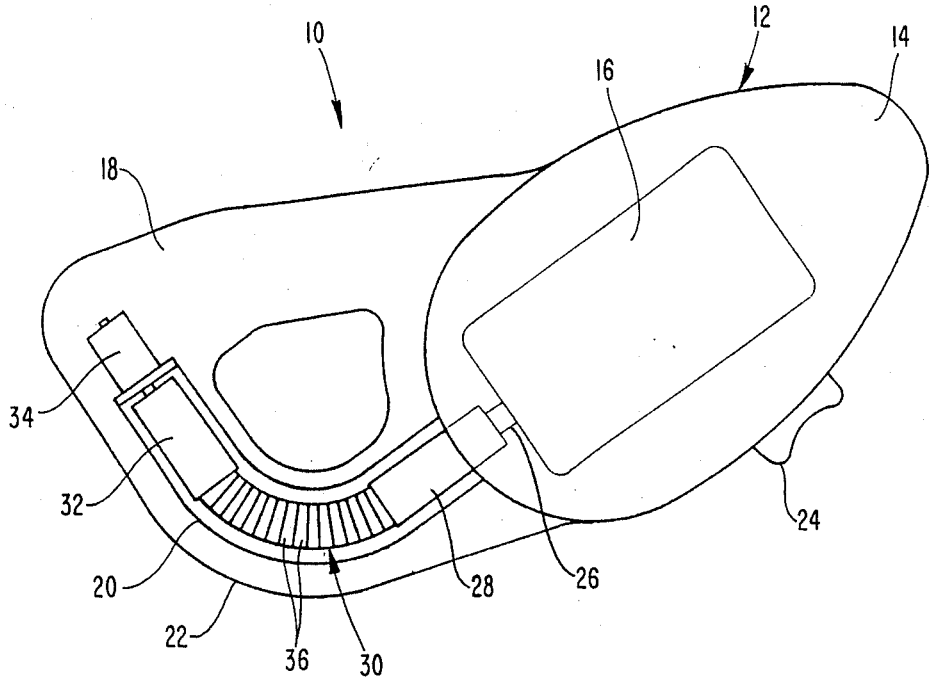
FIG. 1 is a top view of a preferred embodiment of a hand-held hair removal device constructed and operated in accordance with the principles of the present invention.

Referring now to FIG. 1, there is shown a top view of a preferred embodiment of a hand-held removal device 10 constructed and operated in accordance with the principles of the present invention. Device 10 comprises a housing 12, a motor compartment 14 and a miniature electric motor 16 disposed therein. Extending from and integrally formed with housing 12 there is provided a substantially flat, shaped support 18 having an arched slot 20 formed therein proximate its lower edge 22. Electric motor 16 may be battery-operated under control of on-off switch 24, or it may be supplied with power by a conventional cord and plug connection to a household electrical system. A shaft 26 of motor 16 is keyed, and has seated thereon a coupling 28 which protrudes through an opening of motor compartment 14 and into one end of arched slot 20.

Coupling 28 forms one end of a hair-plucking element 30 which is disposed in arched slot 20, a coupling 32 at the other end of element 30 being supported by a bearing 34 which is mounted to support 18. As described further herein, hair-plucking element 30 comprises a plurality of individual discs 36 which are mechanically or frictionally coupled together, such that when powered by motor 16, rotational motion of coupling 28 is transferred via coupled discs 36 to coupling 32. Rotational motion of the individual discs 36 provides the hair plucking operation when element 30 assumes the arched configuration as shown. Preferably, when mechanically coupled, discs 36 are manufactured of a relatively rigid plastic material.

Figure 2:
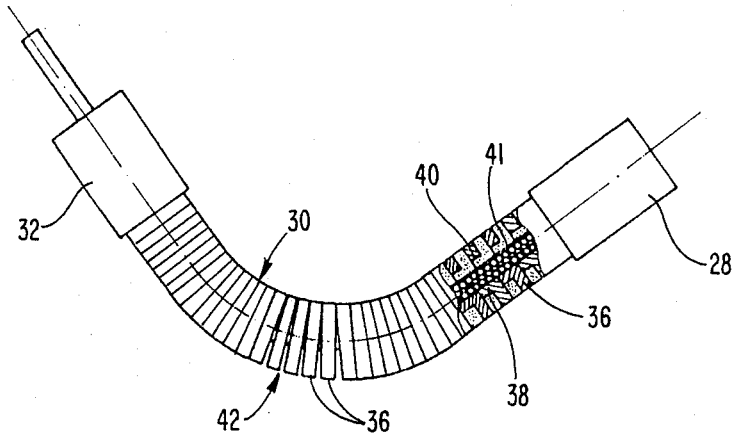
FIG. 2 shows a top view of an arched, mechanically-coupled hair-plucking element for use in the device of FIG. 1.

Referring now to FIG. 2, there is shown a top view of the preferred embodiment of hair-plucking element 30 of FIG. 1 in the arched configuration, revealing further construction details. As can be seen in the partial cross-section, adjacent ones of discs 36 are coupled by substantially perpendicular projections 38 extending from one side of a disc about the center thereof, which engage recesses 40 formed in an adjacent disc 36. Engagement of projections 38 in the recesses 40 on adjacent discs 36 is assured by provision of a centrally-disposed tensioning means 41 which extends through a cavity defined by the centrally-formed holes in each of discs 36.

In the preferred embodiment, tensioning means 41 comprises a spring having its ends retained by couplings 28 and 32. Alternatively, tensioning means 41 could be any suitable elastic material, such as rubber, nylon cord, steel cable and the like. When provided with a pre-tension, tensioning means 41 maintains discs 36 adjacent one another. Since projections 38 engage the recesses on adjacent discs 36 in sliding fashion, when hair-plucking element 30 is provided with an arched configuration as shown, projections 38 are adjusted accordingly, but rotational coupling is maintained. As shown, the arched configuration of hair-plucking element 30 provides spaces 42 on its convex side between individual discs 36.

Operation of hair removal device 10 proceeds by passage of hair-plucking element 30 over the skin where it is desired to remove unwanted hair. As it is passed over the skin, individual hairs 46 are trapped within spaces 42. Due to the rotational motion provided by motor 16, spaces 42 between individual discs 36 of hair-plucking element 30 close on the concave side thereof, at which point trapped hairs are plucked from the skin.

Figure 3A:
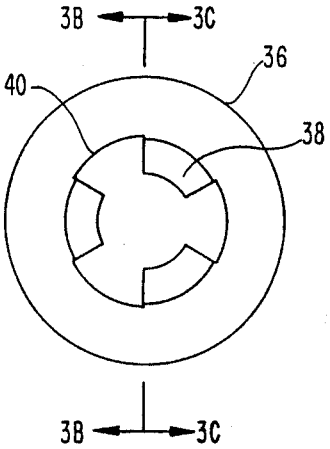
FIG. 3*a–d* are, respectively, enlarged and detailed top and cross-sectional views of a disc similar to that used in construction of the hair-plucking element of FIG. 2.

In FIG. 3*a*, a top view of a disc 36 is shown, revealing the arrangement of projections 38 and recesses 40. In the preferred embodiment, three projections 38 are provided in symmetrical arrangement about the center of disc 36, such that three recesses are defined between projections 38. When assembled as hair-plucking unit 30 and provided with a pre-tension via tensioning means 41, discs 36 are rotationally coupled by projections 38 fitting within recesses 40 of adjacent discs 36.

Figure 3B:
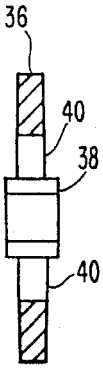
Figure 3C:
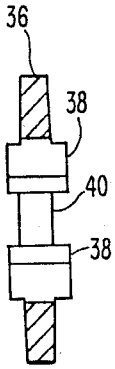
Figure 3D:
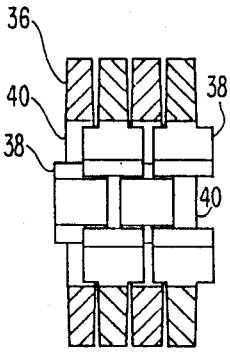

FIGS. 3*b–c* show, respectively, a cross-section of disc 36 taken along respective section lines A—A and B—B, revealing the arrangement of projections 38 and recesses 40. FIG. 3*d* shows a cross-section of a plurality of adjacent discs 36 forming element 30, in which details of the mechanical coupling between projections 38 and recesses 40 are visible.

Figure 4:
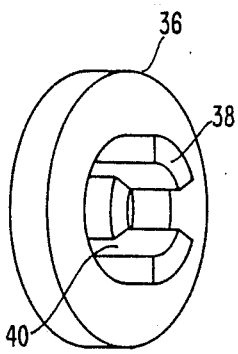
FIG. 4 is an perspective view of the disc of FIG. 3.

FIG. 4 shows a perspective view of an individual one of discs 36, in which projections 38 and recesses 40 are visible. It will be appreciated that while FIGS. 3*b–d* show projections 38 extending from either side of disc 36, FIGS. 2 and 7*a* may be considered as an alternative design, in which projections 38 extend from only one side of a disc 36. In either case, in accordance with the principles of the invention, where projections 38 and recesses 40 are provided, they are arranged such as to insure rotational coupling between adjacent discs 36.

Figure 5:
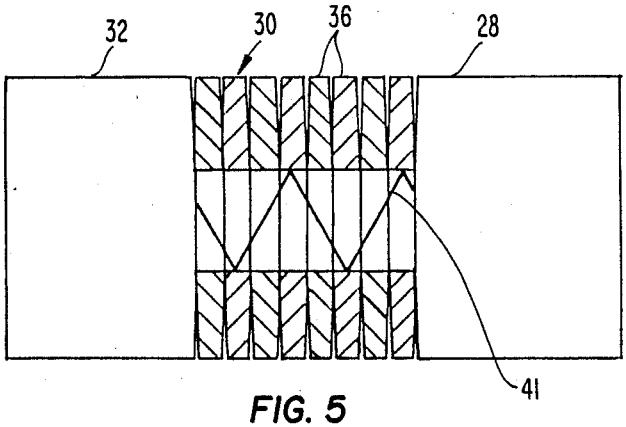
FIG. 5 is a schematic representation of a frictionally-coupled alternative embodiment of the inventive hair-plucking element of FIG. 2.

In FIG. 5, there is shown a schematic illustration of another alternative embodiment of hair-plucking element 30. In this arrangement, discs 36 are made of soft material having a high friction coefficient, and are rotationally coupled by friction between adjacent ones thereof under the pre-tension of tensioning means 41, without the provision of projections 38 and recesses 40.

Figure 6A:
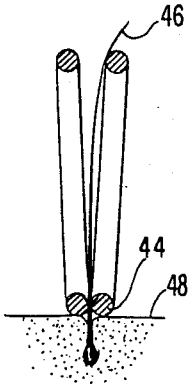
FIG. 6A (PRIOR ART)
FIGS. 6*a–b* illustrate, respectively, general and enlarged views of a grasping action of a single hair by a helical spring used in the construction of a prior art hair removal device.
Figure 6B:
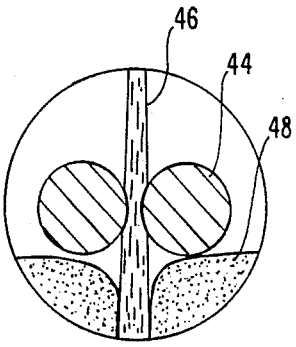
FIG. 6B (PRIOR ART)

In FIGS. 6*a–b*, there is shown a typical arrangement of a prior art design using a helical spring 44 in grasping and plucking individual hairs 46 from the skin 48. Because the contact between the spring 44 and the individual hair 46 is provided essentially at a single point, the likelihood of tearing rather than plucking the hair 46 from the skin 48 is increased. That is illustrated more clearly in the enlarged view of FIG. 6*b*, where it is seen that a hair 46 trapped between loops of a helical spring 44 is "pinched", forming a weak point. As the pulling tension at this point increases, so does the likelihood that the hair 46 will be torn or cut.

Figure 7A:
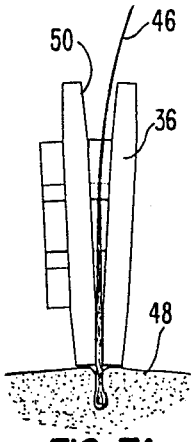
FIGS. 7*a–b* illustrate, respectively, general and enlarged views of a grasping action of a single hair between faces of a pair of discs used in construction of the hair-plucking element of FIG. 2.
Figure 7B:
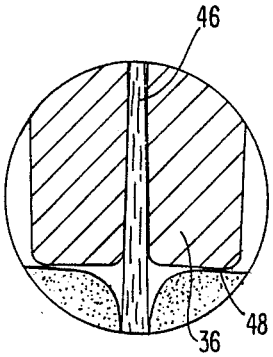

FIGS. 7*a–b* illustrate, respectively, general and enlarged views of a grasping action of a single hair 46 between faces of a pair of discs 36 used in construction of the inventive hair-plucking element 30 of FIG. 2. As shown in FIG. 7*a*, disc 36 has a tapered outer circumferential edge 50, which provides unique advantages in operation for grasping and pulling of individual hairs as described further herein. In addition, as can be seen by comparison of FIGS. 6*b* and 7*b*, contact with the individual hair 46 is made in greater proximity to its root by use of the inventive hair-plucking element 30.

In accordance with the principles of the present invention, the rigid material used for construction of mechanically-coupled hair-plucking element 30 ensures that during rotation, it does not "twist" as it grabs and pulls individual hairs 46 from the skin 48. Rotational motion is evenly transferred all across the length of hair-plucking element 30 by virtue of the mechanically-coupled discs 36. By provision of tapered edges 50 on each of discs 36, individual hairs 46 trapped between them have a portion of their length in contact with the surface area of tapered edges 50, which are substantially parallel. This ensures quick, clean and efficient plucking of hairs 46 with an improved degree of certainty over that of prior art designs. FIG. 7*b* illustrates the extent of the tapered edge 50 surface area over which contact is made with individual hairs 46 in the grasping and plucking operation.

Because spaces 42 within which hair 46 falls are defined between discs 36, the lateral position of each space 42 is maintained during rotation of hair-plucking element 30. Thus, individual hairs which encounter spaces 42 between discs 36 are not deflected sideways as with movement of the spaces between loops of the prior art helical spring 44 design. This increases the chances that even with respect to shorter hairs, inventive hair-plucking element 30 will successfully grasp and pluck them.

It will be appreciated that while hair-plucking element 30 is constructed of mechanically-coupled discs 36 made of relatively rigid material, these may be alternated with frictionally-coupled discs formed of flexible material. Flexible discs tend to conform to the shape of individual hairs 46 as they are grasped during operation. Thus, the surface area of contact is increased, along with the likelihood of successful grasping and plucking of individual hairs 46 from the skin 48.

Having described the invention with regard to certain specific embodiments, it is to be understood that the description is not meant as a limitation since further modifications may now suggest themselves to those skilled in the art and it is intended to cover such modifications as fall within the scope of the appended claims.

I claim:

1. A motor-powered depilatory device comprising:

a manually-held housing;

motor means disposed in said housing; and a longitudinal hair-plucking element coupled at an end thereof to said motor means and being rotatably supported by said housing in arched configuration, said hair-plucking element comprising a plurality of adjacent, axially-aligned discs each having a hole formed centrally therein, the holes of said plurality of discs defining a cavity through which there extends a tensioning means, each of said discs having formed on at least one side thereof at least one substantially perpendicular projection and on the other side thereof at least one corresponding recess for engaging said projection of an adjacently-disposed disc such that said plurality of discs are mechanically coupled together by said tensioning means which flexibly retains them adjacent one another under a predetermined tension to provide rotational coupling along the length of said hair-plucking element, said arched configuration providing said hair-plucking element with spaces on a convex side thereof between adjacent ones of said plurality of mechanically-coupled discs, said spaces being closed on a concave side thereof, rotational motion provided to said hair-plucking element while it is passed over the skin causing plucking of hair trapped within said spaces upon closure of same during rotation.

2. The device of claim 1 wherein said substantially perpendicular projection comprises three tabs symmetrically placed about the disc center, with recesses formed therebetween for rotationally coupling adjacent discs.

3. The device of claim 1 wherein said tensioning means comprises a pre-tensioned spring.

4. The device of claim 1 wherein said tensioning means comprises elastomeric cord.

5. The device of claim 1 wherein said tensioning means comprises metal cable.

6. The device of claim 1 wherein said spaces are formed between tapered edges of said adjacent discs on a convex side of said hair-plucking element.

7. A method of removing unwanted skin hair comprising the steps of:

providing a longitudinal hair-plucking element in arched configuration and being coupled at an end thereof to a means of rotational power, said hair-plucking element comprising:

a plurality of adjacent, axially aligned discs each having a hole formed centrally therein, the holes of said plurality of discs defining a cavity through which there extends a tensioning means, each of said discs having formed on at least one side thereof at least one substantially perpendicular projection and on the other side thereof at least one corresponding recess for engaging said projection of an adjacently-disposed disc such that said plurality of discs are mechanically coupled together by said tensioning means which flexibly retains them adjacent one another under a predetermined tension to provide rotational coupling along the length of said hair-plucking element, said arched configuration providing said hair-plucking element with spaces on a convex side thereof between adjacent ones of said plurality of rotationally-coupled discs, said spaces being closed on a concave side thereof;

and rotating said hair-plucking element while it is passed over the skin to cause plucking of hair trapped within said spaces upon closure of same during rotation.

8. The method of claim 7 wherein each of said discs is made of soft material having a high coefficient of friction such that said plurality of discs are rotationally coupled by friction between them.

* * * * *